US008049704B2

(12) United States Patent
Jang et al.

(10) Patent No.: US 8,049,704 B2
(45) Date of Patent: Nov. 1, 2011

(54) LIQUID CRYSTAL DISPLAY DEVICE

(75) Inventors: Yong-Ho Jang, Gyeonggi-Do (KR); Binn Kim, Seoul (KR); Su-Hwan Moon, Gyeongsangbuk-Do (KR); Nam-Wook Cho, Gyeonggi-Do (KR); Soo-Young Yoon, Gyeonggi-Do (KR)

(73) Assignee: LG Display Co., Ltd., Seoul (KR)

( * ) Notice: Subject to any disclaimer, the term of this patent is extended or adjusted under 35 U.S.C. 154(b) by 993 days.

(21) Appl. No.: 11/173,168

(22) Filed: Jun. 30, 2005

(65) Prior Publication Data

US 2006/0145991 A1 Jul. 6, 2006

(30) Foreign Application Priority Data

Dec. 31, 2004 (KR) ..... 10-2004-0118456

(51) Int. Cl.
*G09G 3/36* (2006.01)

(52) U.S. Cl. ..... 345/100; 345/92

(58) Field of Classification Search ..... 345/84–104, 345/204–215, 690–699; 327/217; 377/64–81
See application file for complete search history.

(56) References Cited

U.S. PATENT DOCUMENTS

| | | | | |
|---|---|---|---|---|
| 6,727,875 | B1 * | 4/2004 | Mikami et al. | 345/92 |
| 7,385,576 | B2 * | 6/2008 | Moon | 345/87 |
| 2004/0217935 | A1 * | 11/2004 | Jeon et al. | 345/100 |
| 2005/0156859 | A1 * | 7/2005 | Jang et al. | 345/100 |
| 2005/0156860 | A1 * | 7/2005 | Kim et al. | 345/100 |
| 2005/0285840 | A1 * | 12/2005 | Jang et al. | 345/100 |

FOREIGN PATENT DOCUMENTS

| | | | |
|---|---|---|---|
| CN | 1113267 | C | 7/2003 |
| GB | 2 146 478 | | 4/1985 |
| JP | 2002-055660 | A | 2/2002 |
| JP | 2003-273228 | A | 9/2003 |
| TW | 385422 | B | 3/2000 |
| TW | 554316 | B | 9/2001 |
| TW | 574679 | B | 2/2004 |
| WO | 03/100511 | A1 | 12/2003 |

OTHER PUBLICATIONS

First Notification of Office Action for corresponding Chinese Patent Application Serial No. 200510082434.1, dated Sep. 21, 2007.
Office Action issued in corresponding Taiwan Patent Application No. 094120828; issued Jul. 14, 2008.
Office Action issued in corresponding Japanese Patent Application No. 2005-190892; mailed Feb. 4, 2009.

* cited by examiner

*Primary Examiner* — Amr Awad
*Assistant Examiner* — Stephen Bray
(74) *Attorney, Agent, or Firm* — Brinks Hofer Gilson & Lione

(57) ABSTRACT

A liquid crystal display (LCD) device comprises a liquid crystal panel having a plurality of pixel regions defined by a plurality of gate lines and data lines, each pixel region associated with a thin film transistor, a gate driving unit having an amorphous semiconductor and integrally formed with the liquid crystal panel capable of sending a scan signal to the gate lines having a pulse width longer than a turned on time of the thin film transistor located within the pixel region, and a data driving unit connected to the data lines capable of sending an image signal to the data lines.

12 Claims, 9 Drawing Sheets

LIQUID CRYSTAL DISPLAY DEVICE

This application claims the benefit of Korean Patent Application No. 10-2004-0118456, filed on Dec. 31, 2004, which is hereby incorporated by reference as if fully set forth herein.

BACKGROUND OF THE INVENTION

1. Field of the Invention

The present invention relates to a liquid crystal display (LCD) device, and more particularly, to a LCD device capable of preventing an inferiority thereof due to a signal lowering by increasing a set pulse width of a scan signal applied to a gate line.

2. Description of the Related Art

A liquid crystal display (LCD) device is a transparent flat panel display device, and is being widely applied to each kind of electronic device such as a mobile phone, a PDA, a notebook computer, etc. Since the LCD device has light, thin, short and small characteristics and can implement a high picture quality, it is being used more than other flat panel display devices. Moreover, as a demand for a digital TV, a high picture quality TV, a wall mounted TV is increased, a large LCD to be applied to the TVs is being researched more actively.

The LCD device is divided into several devices according to a method for driving liquid crystal molecules. Among the several devices, an active matrix thin film transistor LCD device is being mainly used due to a fast response time and less residual image.

FIG. 1 is a view showing a structure of a panel of the TFT LCD. As shown, a plurality of gate lines 3 and data lines 5 arranged horizontally and vertically for defining a plurality of pixels are formed on the liquid crystal panel 1. A thin film transistor acting as a switching device is arranged in each pixel and is switched when a scan signal is sent to the pixel through the gate line 3 thereby to apply an image signal sent through the data line 5 to a liquid crystal layer 9. The reference numeral 11 denotes a storage capacitor for sustaining a data signal received until the next scan signal is sent to the pixel.

A scan signal is applied to the gate line 3 from a gate driving unit 20, and an image signal is applied to the data line 5 from a data driving unit 34. Generally, the gate driving unit 20 and the data driving unit 34 are formed of a driver integrated circuit (IC) and arranged outside the liquid crystal panel 1. However, recently, an LCD device in which the gate driving unit 20 is integrally formed at the liquid crystal panel is being actively researched. As the gate driving unit 20 is integrally formed at the liquid crystal panel 1, the LCD device has a decreased volume and fabrication costs can be reduced.

The data driving unit 34 is mounted on a flexible circuit board 30 for connecting the liquid crystal panel 1 to a printed circuit board 36, and applies an image signal onto the liquid crystal layer 9 through the data line 5. On the printed circuit board 36, a timing controller and a line are formed.

FIG. 2 is a view schematically showing a structure of the gate driving unit 20. As shown, the gate driving unit 20 is provided with a plurality of shift registers 22. Signals are sequentially produced from the shift registers 22 and applied to the gate lines G1~Gn. The shift register 22 is connected to a clock generating unit 24, and thus a clock signal generated from the clock generating unit 24 is applied to the shift registers 22. A start voltage is sent to the shift registers 22, and an output signal of the previous shift register is sent to the next shift register as a start voltage after the first shift register.

FIG. 3 is a waveform view showing a start signal S, clock signals C1, C2, C3, and C4 sent to the shift register, and output voltages Vout1 to Voutn generated from the shift register 22. As the start signal S and the clock signals C1, C2, C3, and C4 are respectively sent to each stage of the shift register, the shift register 22 of each stage produces the output signals Vout1 to Voutn thereby to sequentially apply the output signals to gate lines.

The gate driving unit is integrally formed with a liquid crystal panel portion. That is, the shift register 22 is integrally formed on a substrate with a liquid crystal panel portion. Accordingly, a transistor, etc. constituting the shift register 22 is formed by a photolithography like a thin film transistor and acts as a switching device formed at a pixel region of the liquid crystal panel portion. The transistor is generally fabricated by using an amorphous silicon. A gate driving unit to which the shift register having the transistor fabricated by using an amorphous silicon is applied has the following problems.

As output voltages from the shift register 22 are applied to the thin film transistor of the pixel region as scan signals, the thin film transistor is turned on and at the same time, an image signal applied from the data driving unit is charged to a storage capacitor through a channel of the turned-on thin film transistor. That is, during a first period of an output voltage of a rectangular wave form shown in FIG. 3 (1H, that is, the period that a thin film transistor of a liquid crystal panel is turned on or the time that a signal is applied to a pixel), a signal is applied to the liquid crystal layer and a signal is charged to the storage capacitor.

Generally, an amorphous silicon is known to have a low field effect mobility. The low field effect mobility prevents a scan signal applied to the thin film transistor of the pixel region (that is, an output voltage of the shift register) from being a perfect rectangular wave. As shown in FIG. 4, the time of a signal rise and the time of a signal fall are delayed thereby to form a lowered tail region of an ideal rectangular wave. The rectangular wave decreases the turned ON time of the thin film transistor, thereby decreasing an effective time that an image signal is charged to the liquid crystal panel and thus deteriorating a picture quality of the LCD device.

As a resolution of the LCD device increases, the time for charging an image signal is decreased. For example, the time for charging an image signal in one pixel is approximately 60 μsec in case of a QVGA-LCD device. On the contrary, the time for charging an image signal in one pixel is approximately 20 μsec in case of an XGA-LCD device of a high resolution. As the charging time decreases, the lowering of the scan signal due to a low field effect mobility causes an effective charging time to be decreased much more. Accordingly, a picture quality of the LCD device may be degraded in the case of a high resolution device.

In order to solve the problem due to the low field effect mobility, the thin film transistor has to be fabricated to have a very large size (for example, several thousands of μm). However, since a region for forming a gate driving unit is greatly increased, the method was substantially impossible.

SUMMARY OF THE INVENTION

A disclosed LCD device prevents an inferiority thereof due to a signal lowering by increasing a pulse width of a scan signal applied to a thin film transistor inside a pixel region through a gate line more than the turned on time of the thin film transistor. Also described is an LCD device that effectively prevents an inferiority thereof due to a signal lowering by applying a scan signal overlapped to an adjacent gate line without increasing the LCD size or the fabrication cost.

A LCD device comprises a liquid crystal panel that has a plurality of pixels defined by a plurality of gate lines and data lines. Pixel regions are formed as each pixel is provided with a thin film transistor. A gate driving unit is connected to the liquid crystal panel for sending a scan signal having a pulse width longer than a turned on time of a thin film transistor of a pixel region to the gate lines. A data driving unit connected to the data lines sends an image signal to the data lines.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

In order to prevent a distortion of a scan signal applied to a thin film transistor formed at a pixel region (that is, a tail of an output waveform due to a signal lowering), the following methods are used. First, a size of the thin film transistor is increased thereby to minimize an influence by a lower field effect mobility. Second, the thin film transistor is formed of poly-crystalline silicon not amorphous silicon thereby to increase a field effect mobility. The first method is substantially impossible because the size of a gate driving unit integrally formed at a liquid crystal panel is increased as the size of the thin film transistor is increased. The second method is substantially possible but is not effective due to a high fabrication cost and complicated fabrication processes.

The present invention is to prevent scan signals applied to gate lines from being distorted by a different method. That is, the present invention is to prevent scan signals applied to gate lines from being distorted without using poly crystalline silicon or without increasing the size of a gate driving unit.

The distortion of the scan signal decreases the turned on time of the thin film transistor, the switching device inside the pixel region and thereby the time for charging a source signal in the pixel for the turned on time of the thin film transistor is shortened. Accordingly, if the turned on time of the thin film transistor is maintained for a set time, a crystallization of a semiconductor layer or a size increment of the thin film transistor is not required.

In the present invention, the turned on time of the thin film transistor, that is, a width of a scan signal applied to the thin film transistor, the switching device of the pixel region is controlled thereby to completely turn on the thin film transistor for a preset time and thus to prevent an inferiority of the LCD device.

Figure 5:
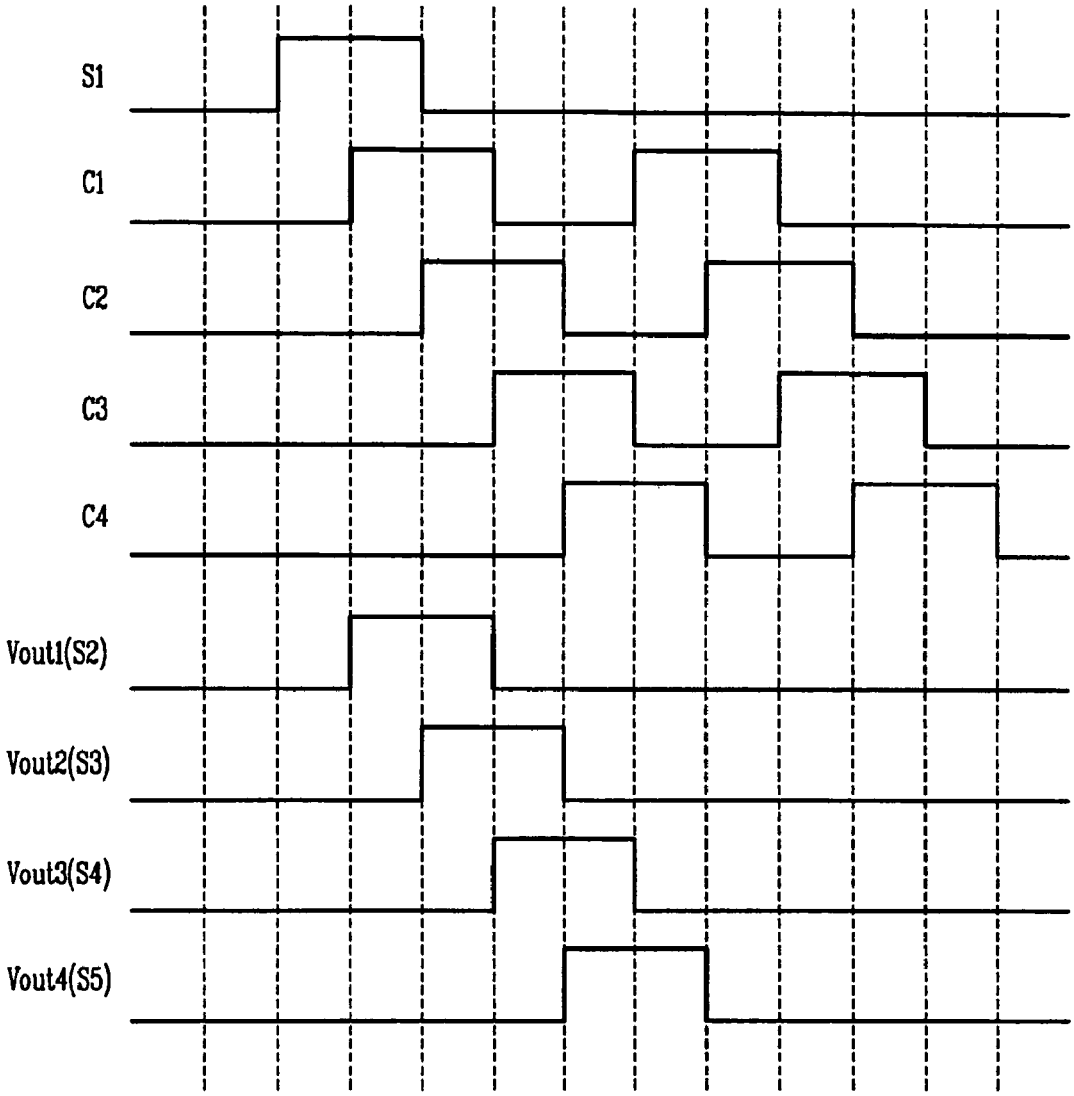
FIG. 5 is a waveform view showing a gate driving unit of an LCD device according to the present invention.

FIG. 5 shows output voltages (that is, scan signals, Vout1, Vout2, Vout3, and Vout4) generated from the shift register and applied to the thin film transistor of the pixel region through gate lines. Each output voltage is sent to each gate line thereby to operate each thin film transistor connected to each gate line. As shown, a pulse width of an output voltage sent to a specific gate line is increased to be overlapped with a pulse width of a signal sent to an adjacent gate line. Accordingly, even if a signal is lowered by a low field effect mobility of an amorphous semiconductor, the thin film transistor connected to the corresponding gate line can be completely turned on for a preset time. At this time, set pulses of clock signals generated from a clock generating unit to be sent to the shift register are increased, so that adjacent pulses are overlapped to each other.

Figure 6:
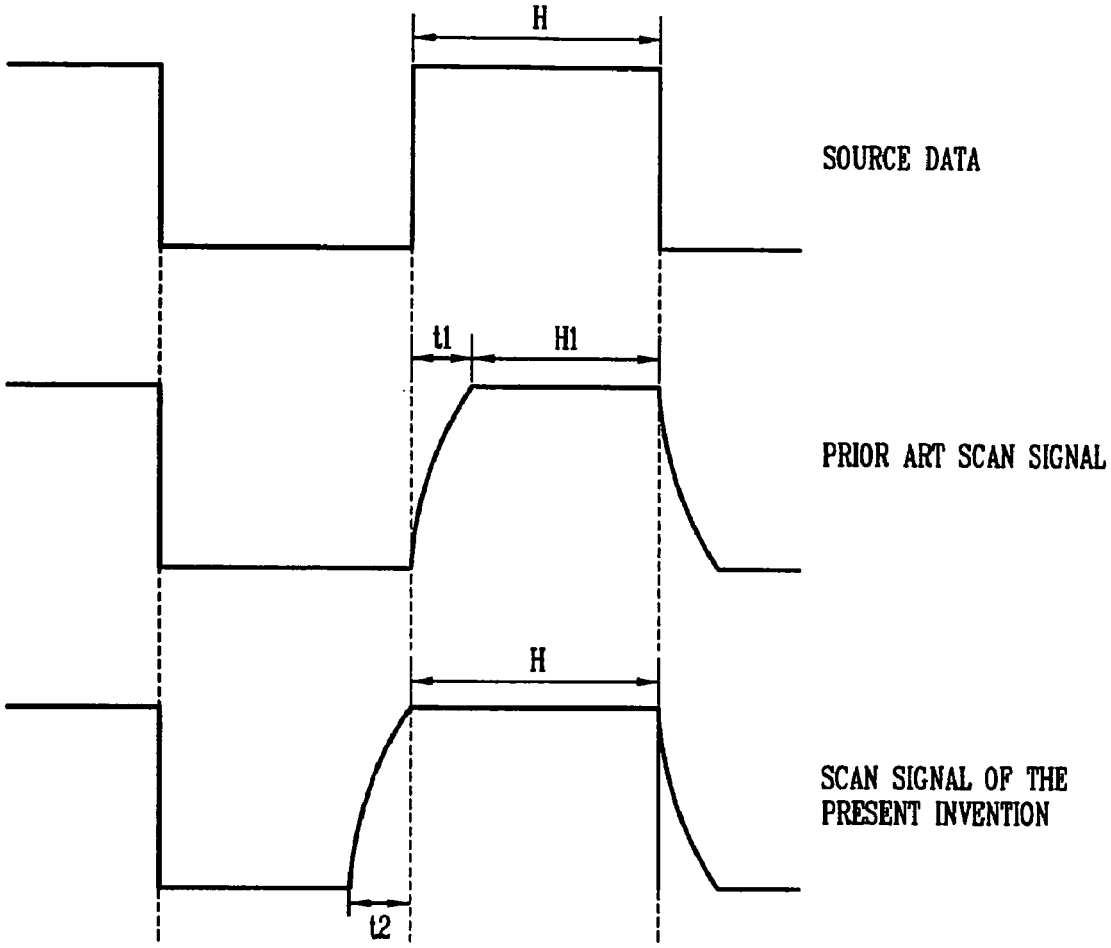
FIG. 6 is a waveform view showing a pulse of a scan signal produced from the gate driving unit according to the related art, and a waveform view showing a pulse of a scan signal produced from the gate driving unit according to the present invention.

FIG. 6 is a waveform view showing source data applied to data lines of a liquid crystal panel, the related art scan signal applied to gate lines, and a scan signal according to the present invention. As shown, the thin film transistor has to be turned on for a pulse width H of a source signal in order to completely charge the source signal to a pixel. However, in the related art, the scan signal of which pulse is lowered for the period of t1 is applied to a thin film transistor of a pixel region through a gate line. Accordingly, the thin film transistor is partially turned on for the period of t1 (that is, the thin film transistor is turned on only by a signal more than a threshold voltage) even if the thin film transistor is completely turned on for the period of H1. Accordingly, only a part of the source data applied to the data lines through the thin film transistor is inputted to the pixel.

In the present invention, a pulse width of the scan signal applied to the gate line is increased as much as the period of t2. The period of t2 denotes the time for which a signal is lowered (from maximum amplitude), and is the same as the related art period of t1 for which a signal is lowered (that is, t1=t2). Accordingly, a pulse of a complete rectangular wave is sent to the pixel for the period of H, and thereby the thin film transistor inside the pixel region is turned on for the period of H. Accordingly, a complete source signal is charged to the pixel.

In case of using an amorphous semiconductor in the present invention, a pulse width of a scan signal is increased as much as a lowered signal width by considering a signal lowering due to a low field effect mobility, thereby turning on the thin film transistor inside the pixel region for a desired time and thus completely charging a source signal to the pixel. Accordingly, as shown in FIG. 5, an overlapped signal is applied to adjacent gate lines.

Figure 1:
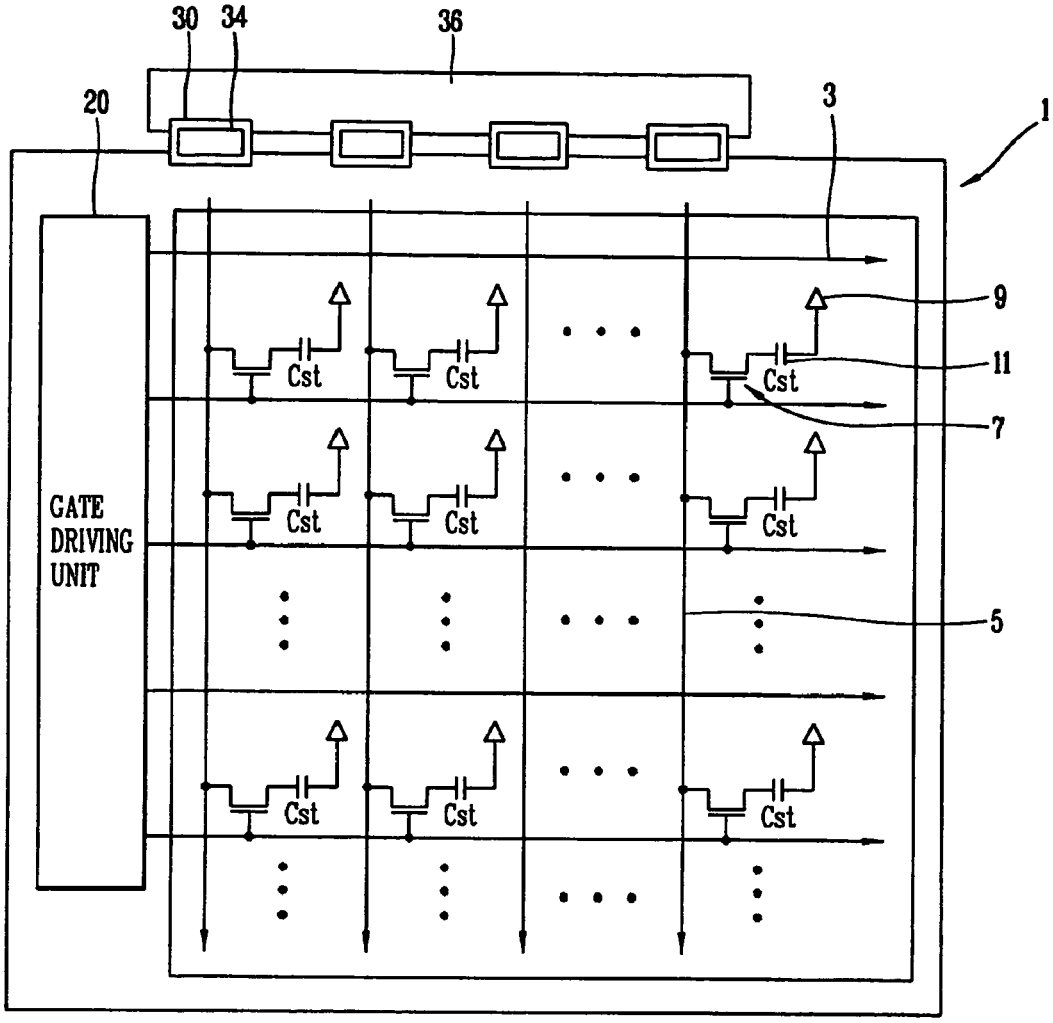
FIG. 1 RELATED ART
FIG. 1 is a plane view showing a general liquid crystal display (LCD) device.
Figure 2:
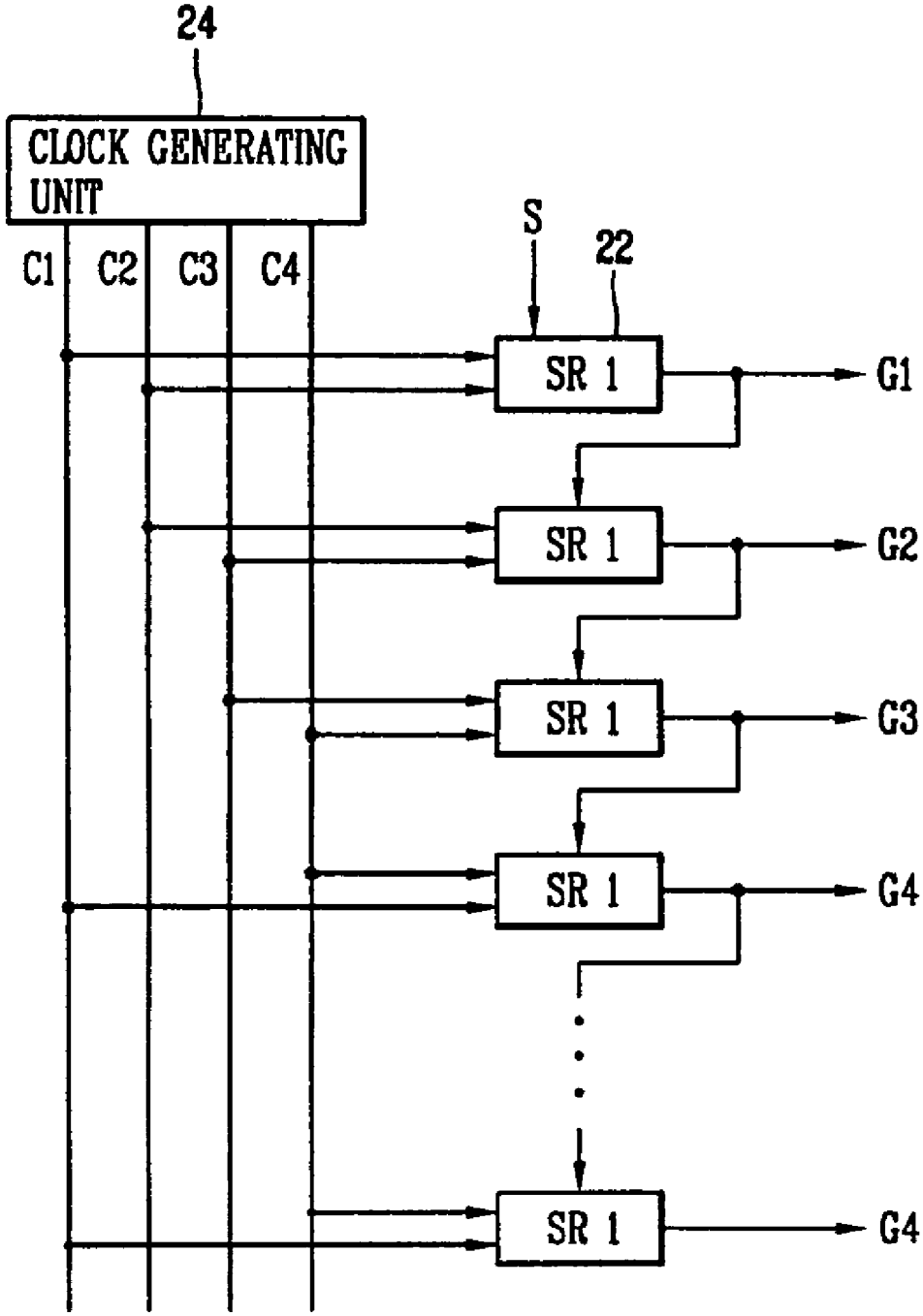
FIG. 2 RELATED ART
FIG. 2 is a block diagram showing a structure of a gate driving unit of the LCD device in accordance with the related art.
Figure 3:
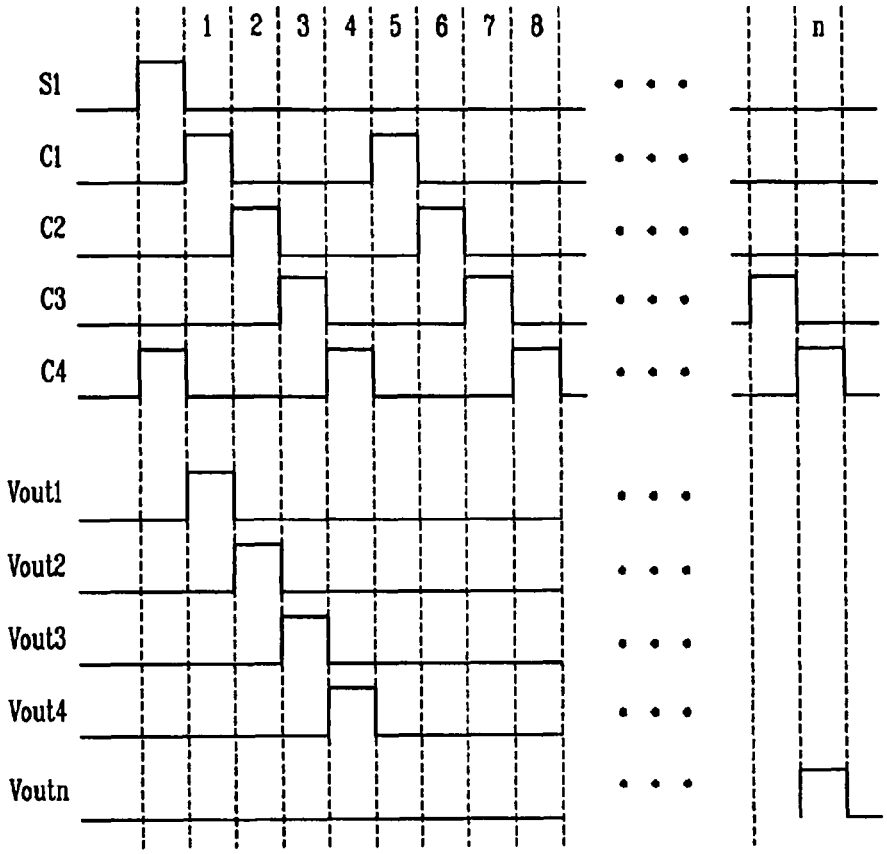
FIG. 3 RELATED ART
FIG. 3 is a waveform view showing the gate driving unit of FIG. 2.
Figure 4:
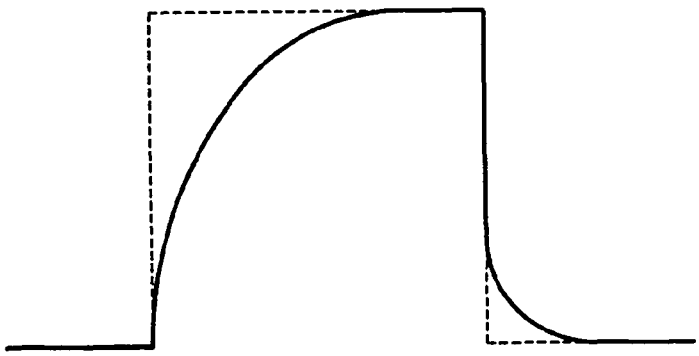
FIG. 4 RELATED ART
FIG. 4 is a waveform view showing a pulse of an output voltage from the gate driving unit in accordance with the related art.
Figure 7:
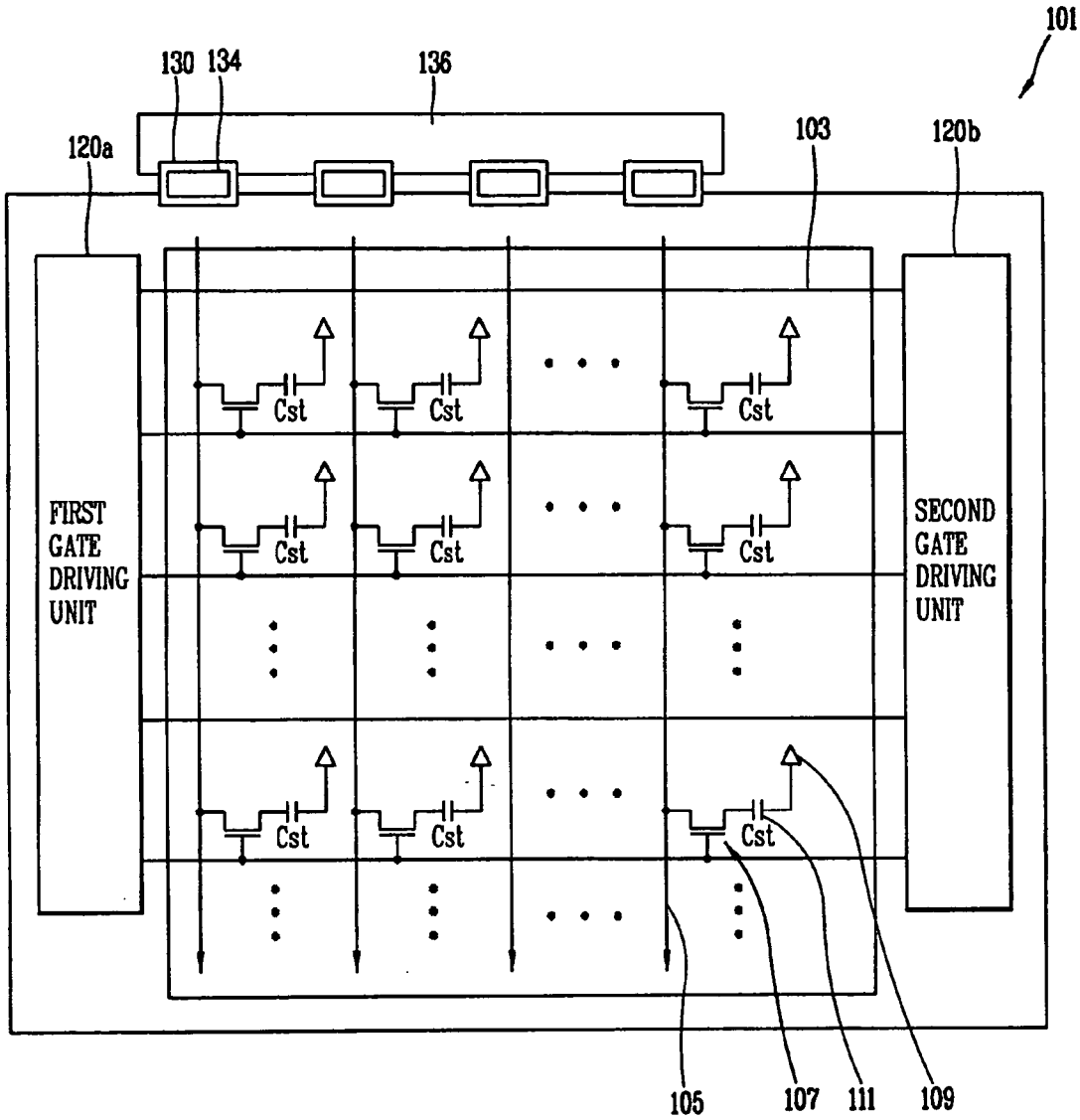
FIG. 7 is a view showing an LCD device according to the present invention.

FIG. 7 is a view showing an LCD device according to the present invention. The LCD device shown in FIG. 7 is the same as the LCD device shown in FIG. 1 except having gate driving units 120*a* and 120*b*, thereby the minute explanations are omitted.

As shown, two gate driving units 120*a* and 120*b* are positioned at an outer region of a liquid crystal panel 101. The gate driving units 120*a* and 120*b* are integrally formed with a thin film transistor of a pixel region by the same process, and are provided with a thin film transistor of an amorphous semiconductor therein. The first gate driving unit 120*a* is connected to odd numbered gate lines among gate lines 103 formed in the pixel region, and the second gate driving unit 120*b* is connected to even numbered gate lines. That is, the gate lines 103 are alternately connected to the first gate driving unit 120*a* and the second gate driving unit 120*b*, and thereby scan signals are applied to the gate lines 103 from the gate driving units 120*a* and 120*b*.

The first gate driving unit 120*a* and the second gate driving unit 120*b* respectively produce output voltages (scan signals) sequentially. The output signals produced from the first gate driving unit 120*a* and the second gate driving unit 120*b* are overlapped with each other, and the overlapped scan signal is applied to the adjacent gate line 103.

In the present invention, the first gate driving unit 120*a* and the second gate driving unit 120*b* for applying a scan signal to the gate lines are arranged at both sides of the liquid crystal panel. However, the structure or the position of the gate driving units is not important. That is, one gate driving unit may be formed or two gate driving units may be formed under a condition that the thin film transistor of the pixel region can be completely turned on for a set time by producing a signal having an increased pulse width. Also, the first and second gate driving units can be placed at any position under a condition that signals are sequentially produced from the first and second gate driving units and then overlapped signals are applied to the gate lines.

The structure of the first and second gate driving units 120*a* and 120*b* will be explained in more detail with reference to FIG. 8.

Figure 8:
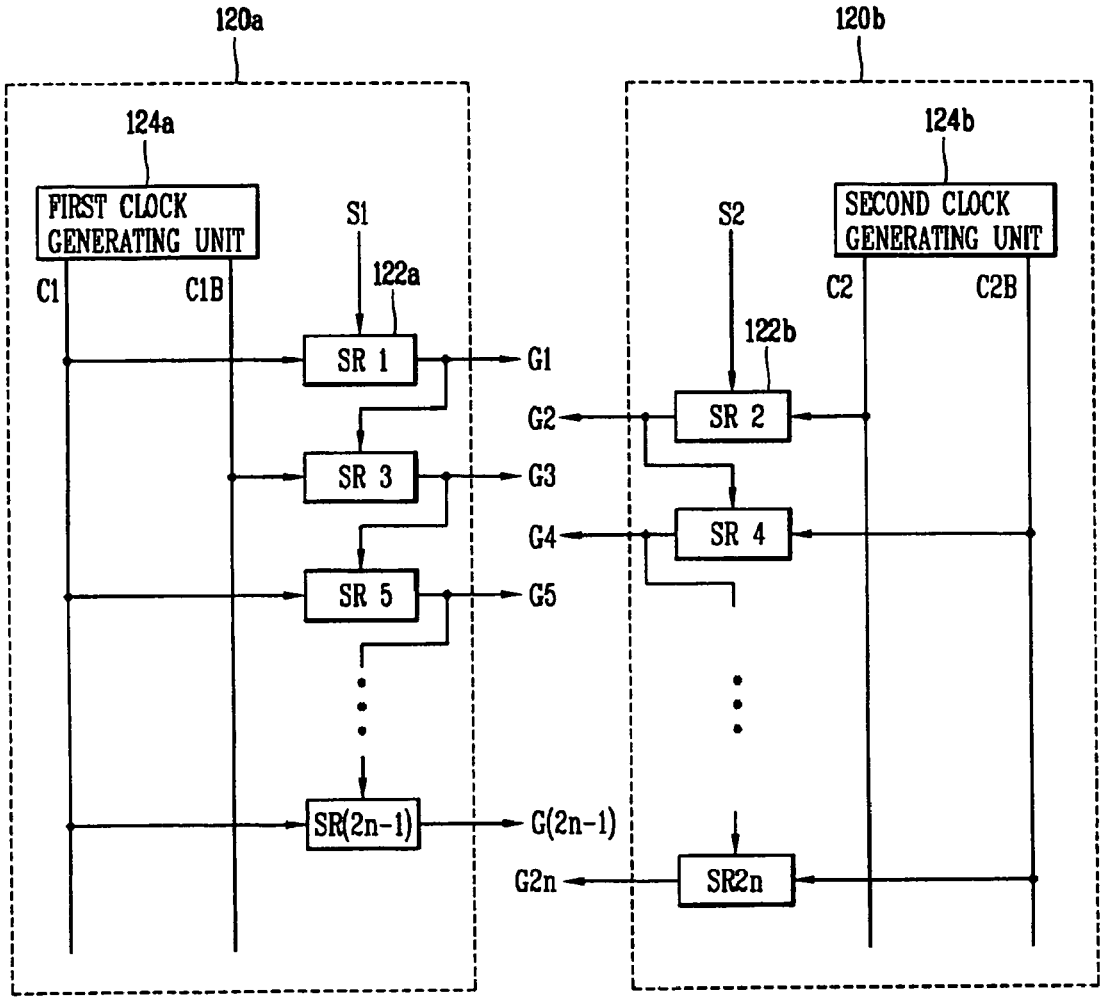
FIG. 8 is a block diagram showing a structure of a gate driving unit of the LCD device according to the present invention.

FIG. 8 is a block diagram showing a structure of a shift register formed at the gate driving units 120*a* and 120*b* for producing a signal to the gate line of the pixel region.

As shown, the first gate driving unit 120*a* and the second gate driving unit 120*b* are respectively provided with a plurality of first shift registers 122*a* and second shift registers 122*b*. Signals are sequentially produced from the first shift registers 122*a* and the second shift registers 122*b* and then are respectively applied to odd numbered gate lines G1 to G(2*n*−1) and even numbered gate lines G2 to G2*n*.

The first shift registers 122*a* and the second shift registers 122*b* are respectively connected to a first clock signal generating unit 124*a* and a second clock generating unit 124*b*, so that clock signals generated from the first clock generating unit 124*a* and the second clock generating unit 124*b* are applied to the first shift registers 122*a* and the second shift registers 122*b*. A start signal S1 and a start signal S2 are respectively sent to the first shift registers 122*a* and the second shift registers 122*b*. Herein, an output signal of the previous stage is sent to the next stage of each of the first and second shift registers 122*a* and 122*b* as a start signal after the first stage.

Pulse widths of the scan signals sent from the first shift registers 122*a* and the second shift registers 122*b* and applied to the gate lines G1 to G2*n* are increased as much as the turned on time of the thin film transistor of the pixel region thereby to be partially overlapped with adjacent signals. The shift register of the gate driving unit for generating a signal will be explained as follows.

Figure 9:
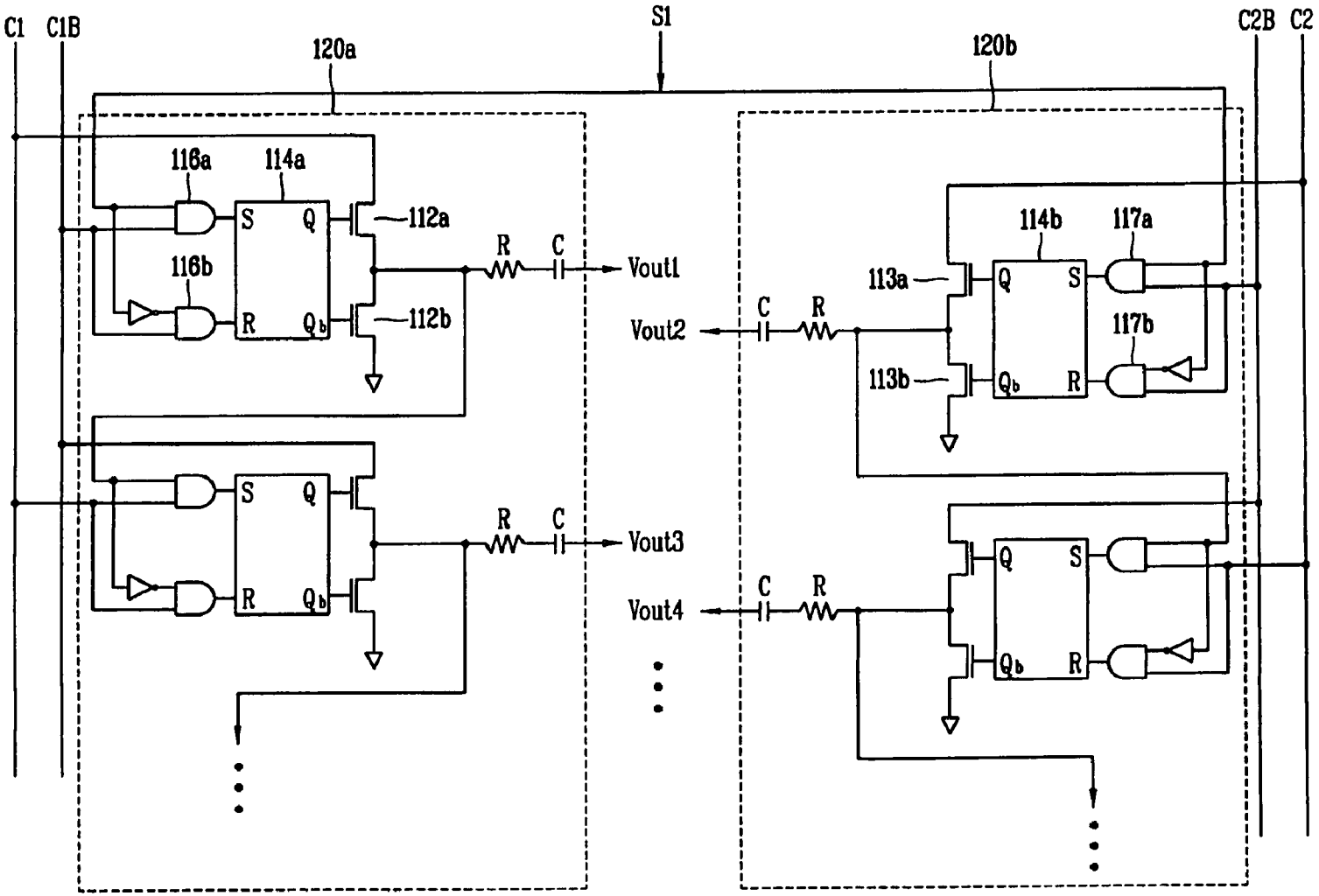
FIG. 9 is a circuit diagram showing the gate driving unit of the LCD device according to the present invention.

FIG. 9 is a circuit diagram showing the gate driving units of FIG. 8 according to the present invention, in which a flip flop is shown. The flip flop is illustrated for explanation of the function of the shift register, and does not indicate a specific electric device. Therefore, the term of the flip flop can be substituted into a proper term for indicating a function.

As shown in FIG. 9, a first transistor 112*a* and a second transistor 112*b* are connected to an output terminal of the shift register of a first stage of the first gate driving unit 120*a*. Also, a third transistor 113*a* and a fourth transistor 113*b* are connected to an output terminal of the shift register of a first stage of the second gate driving unit 120*b*. Each gate of the first and second transistors 112*a* and 112*b* and each gate of the third and fourth transistors 113*a* and 113*b* are respectively connected to a Q terminal and Qb terminal of the first flip flop 114*a* and the second flip flop 114*b*.

A first logic gate 116*a* and a second logic gate 116*b* are connected to S and R input terminals of the first flip flop 114*a*, and a third logic gate 117*a* and a fourth logic gate 117*b* are connected to S and R input terminals of the second flip flop 114*b*.

Each source of the first transistor 112*a* and the third transistor 113*a* is connected to a clock generating unit (not shown) and clock signals C1 and C2 are respectively sent to the sources. Output terminals are connected to each drain of the first transistor 112*a* and the third transistor 113*a* and to each source of the second transistor 112*b* and the fourth transistor 113*b*. Also, each drain of the second transistor 112*b* and the fourth transistor 113*b* is connected to a ground. Clock signals C1B and C2B and a start signal S1 are respectively sent to the logic gates 116*a*, 116*b*, 117*a*, and 117*b* respectively connected to the S and R input terminals of the first flip flop 114*a* and the second flip flop 114*b*.

Figure 10:
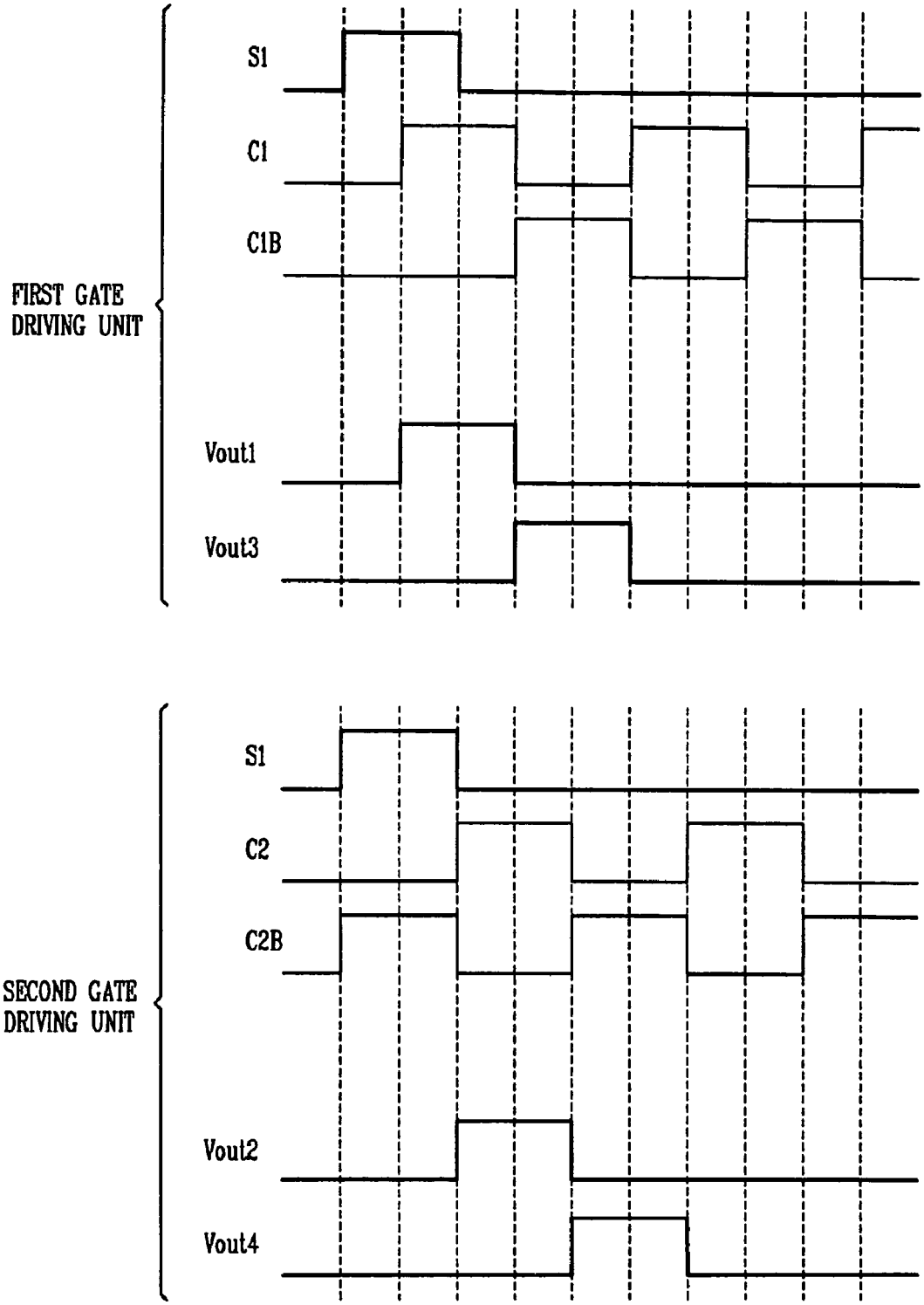
FIG. 10 is a waveform view showing the gate driving unit of FIG. 9.

FIG. 10 is a waveform view showing the start signal S1 and the clock signals C1, C1B, C2, and C2B of the gate driving units 120*a* and 120*b*, and output voltages Vout1, Vout2, Vout3, and Vout4 produced from output terminals and applied to gate lines. In FIG. 10, the waveform is shown on the basis of the first gate driving unit and the second gate driving unit.

As shown, clock signals C1 and C1B produced from a first clock generating unit (not shown) are signals increased by two times of the related art clock signals, and are synchronized thereby to be sequentially applied to the shift registers of the first gate driving unit. Also, clock signals C2 and C2B produced from a second clock generating unit (not shown) are signals increased by two times of the related art clock signals, and are synchronized thereby to be sequentially applied to the shift registers of the second gate driving unit 120*b*. Pulse widths of a high state of signals produced from the shift registers of the first stages of the first gate driving unit 120*a* and the second gate driving unit 120*b* (that is, C1, C2, C1B, and C2B) are overlapped with each other as much as a half period (that is, the overlapped degree is not limited to the half period).

An operation of the shift register by the start signal S1 and the clock signals C1, C1B, C2, and C2B and an output waveform thereof will be explained in more detail.

As shown in FIG. 9, when the start signal S1 of a low stage is sent to the shift register of the first stage of the first gate driving unit 120*a* and the clock signals C1 and C1B of a low state are sent thereto, the low signals are respectively applied to the S and R input terminals of the first flip flop 114*a*.

Accordingly, the first flip flop 114*a* maintains the previous state, the Q terminal produces a high signal, and the Qb terminal produces a low signal. Accordingly, the first transistor 112*a* is turned on and the second transistor 112*b* is turned off, so that the clock signal C1 is produced as the output voltage Vout1 and thereby the output voltage Vout1 becomes low.

Then, if the start signal S1 of a high state and the clock signals C1 and C1B of a low state are sent to the shift register, the low signals are respectively applied to the S and R input terminals of the flip flop 114. Accordingly, the flip flop 114 maintains the previous state, the Q terminal outputs a high signal, and the Qb terminal sends a low signal. Accordingly, the first transistor 112*a* is turned on and the second transistor 112*b* is turned off, so that the clock signal C1 is produced as the output voltage Vout1 and thereby the output voltage Vout1 becomes low.

Then, if the clock signal C1 becomes high under a state that the start signal S1 maintains the high state, the clock signal C1 of the high state is produced through the turned on first transistor 112*a*. Accordingly, the output voltage Vout1 becomes high. The output voltage Vout1 of the high state is maintained until the clock signal C1B becomes high. That is, when the clock signal C1B becomes high (the start signal S1 is low), the low signal and the high signal are respectively sent to the S and R terminals of the first flip flop 114*a*. Accordingly, the first flip flop 114*a* is reset, and the low signal and the high signal are respectively sent to the Q and Qb output terminals. Accordingly, the first transistor 112*a* is turned off and the second transistor 112*b* is turned on, so that the output voltage Vout1 becomes low.

Then, if the start signal S1 of a low state, the clock signal C1 of a high state, and the clock signal C1B of a low state are sent to the shift register, the low signals are respectively applied to the S and R input terminals of the flip flop 114. Accordingly, the flip flop 114 maintains the previous state, the Q terminal outputs a low signal, and the Qb terminal outputs a high signal. Accordingly, the first transistor 112*a* is turned on and the second transistor 112*b* is turned off, so that the output voltage Vout1 becomes low and the low state of the output voltage Vout1 is continuously maintained.

As the start signal S1 is sent to the shift register of the first stage, the output voltage Vout1 is produced from an output terminal of the shift register of the first stage and the output voltage is applied to the first gate line of the LCD device.

The output voltage Vout1 produced from the shift register of the first stage of the first gate driving unit 120*a* is sent to the shift register of the next stage as a start signal thereby to enable the shift register of the next stage. The shift register of the next stage is operated like the shift register of the first stage thereby to produce the third output voltage Vout3 synchronized with the first output voltage Vout1 and to apply the output voltage Vout3 to the third gate line. As the operation is repeated, sequential output voltages Vout1 to Vout (2*n*−1) are applied to odd numbered gate lines.

Clock signals C2 and C2B overlapped with the clock signals C1 and C1B sent into the shift register of the first stage of the first gate driving unit 120*a* as much as a half period are sent to the shift register of the first stage of the second gate driving unit 120*b*. As the clock signals C2 and C2B and the start signal S1 are sent to the shift register, the second output voltage Vout2 overlapped with the first output voltage Vout1 as much as a half period is produced thereby to be applied to the second gate line. The second output voltage Vout2 is sent to the shift register of the next stage as a start signal, and thereby a sequential fourth output voltage Vout4 is produced to be applied to a fourth gate line. As the above operation is repeated, the output voltages Vout2~Vout2*n* overlapped with the output voltages Vout1~Vout(2*n*−1) produced from the shift register of the first gate driving unit 120*a* as much as a half period are applied to even numbered of gate lines the shift register of the second gate driving unit 120*b*.

As aforementioned, in the LCD device of the present invention, the first gate driving unit and the second gate driving unit having a plurality of the shift registers for sequentially producing output voltages are provided at the liquid crystal panel, thereby respectively applying output voltages to odd numbered gate lines and even numbered gate lines. The output voltages produced from the shift registers of the first and second gate driving units for alternately applying scan signals to the odd numbered gate lines and the even numbered gate lines have a pulse width longer than the turned on period of the thin film transistor, the switching device of the pixel region, so that the scan signals are overlapped with each other as much as a certain pulse width (for example, a half period). Accordingly, even if the scan signal has a pulse partially lowered by a low field effect mobility as the thin film transistor formed at the shift register is formed of an amorphous semiconductor, a signal applied to the thin film transistor of the pixel region inside the liquid crystal panel completely turns on the thin film transistor. Accordingly, an inferiority of the LCD device caused as a turned on time of the thin film transistor is decreased is prevented.

An increased pulse width of the scan signals respectively produced from the shift registers of the first gate driving unit and the second gate driving unit (that is, an overlapped width between adjacent signals) is not limited to a half period. That is, the increased pulse width of the scan signal can be controlled as long as the thin film transistor in the pixel region can be completely turned on according to a lowered degree of the scan signal due to a low field effect mobility of the amorphous semiconductor.

As aforementioned, in the present invention, the pulse width of the scan signal applied to the gate line is increased more than the turned on time of the thin film transistor inside the pixel region. Accordingly, the thin film transistor can always maintain the turned on state for a preset time even if the scan signal is lowered. Therefore, the inferiority of the LCD device due to the signal lowering can be prevented without increasing the size of the thin film transistor formed at the gate driving unit or without using expensive polysilicon.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A liquid crystal display (LCD) device comprising:

a liquid crystal panel having a plurality of pixel regions defined by a plurality of gate lines and a plurality of data lines, each pixel region being associated with a thin film transistor;

a first gate driving unit and a second gate driving unit connected with the liquid crystal panel, the first and second gate driving units are made of an amorphous semiconductor, and the first and second gate driving units operable to send scan signals to odd numbered gate lines and even numbered gate lines respectively, each scan signal is extended as wide as a width of a signal lowered due to a low field effect mobility of the amorphous semiconductor, thereby having a pulse width greater than a turn-on time of a thin film transistor formed at the pixel region, wherein each of the first gate driving unit and the second gate driving unit include a clock signal generating unit which generates a plurality of clock signals C1, C1B and C2, C2B respectively for use by a plurality of shift registers, where the plurality of shift registers generate output voltages according to the clock signals received from the clock signal generating units, the shift register including:

a flip flop having R and S input terminals and Q and Qb output terminals;

a first logic gate and a second logic gate connected respectively to the R and S input terminals, a start signal and the clock signal C1B being inputted to the first logic gate and the second logic gate; and a first transistor having a gate connected to the Q output terminal, a source connected to the clock signal generating unit and the clock signal C1 being inputted to the source and a drain connected to the gate line;

a second transistor having a gate connected to the Qb output terminal, a source connected to the drain of the first transistor and the gate line, and a drain connected to a ground; and a data driving unit connected to the data lines operable to send an image signal to the data lines, wherein the scan signal has a turn off period, and a turn on period including a first period for partially turning on a thin film transistor and a second period for fully turning on a thin film transistor, where the first period is shorter than the second period, and wherein the turn on period is extended by a width corresponding to the first period.

2. The LCD device of claim 1, wherein the first gate driving unit and the second gate driving unit each produce synchronized signals sequentially.

3. The LCD device of claim 1, wherein the scan signals produced from the first gate driving unit and the second driving unit are applied to adjacent gate lines and have pulse widths that overlap with each other.

4. The LCD device of claim 1, wherein the plurality of shift registers receive a start signal.

5. The LCD device of claim 4, wherein the start signal sent to a shift register after a first stage is an output voltage of a previous stage.

6. The LCD device of claim 1, wherein the clock signals generated by the first gate driving unit partially overlap the clock signals generated by the second gate driving unit.

7. The LCD device of claim 1, wherein the first gate driving unit and the second gate driving unit are integrated with the liquid crystal panel at opposite sides of the liquid crystal panel.

8. A method of increasing a set pulse width within a liquid crystal display, the method comprising:

providing a liquid crystal panel having a plurality of gate lines, a plurality of data lines, and a plurality of thin film transistors;

integrating a first gate driving unit with the liquid crystal panel;

integrating a second gate driving unit with the liquid crystal panel;

sending scan signals to odd numbered gate lines;

sending scan signals to even numbered gate lines; and sending an image signal to each of the plurality of data lines, wherein each scan signal is extended as wide as a width of a signal lowered due to a low field effect mobility of the amorphous semiconductor, thereby having a pulse width greater than a turn-on time of a thin film transistor formed at a pixel region, wherein each of the first gate driving unit and the second gate driving unit include a clock signal generating unit that generates a plurality of clock signals C1, C1B and C2, C2B respectively for use by a plurality of shift registers, where the plurality of shift registers generate output voltages according to clock signals received from the clock signal generating units, the shift register including:

a flip flop having R and S input terminals and Q and Qb output terminals;

a first logic gate and a second logic gate connected respectively to the R and S input terminals, a start signal and the clock signal C1B being inputted to the first logic gate and the second logic gate; and a first transistor having a gate connected to the Q output terminal, a source connected to the clock signal generating unit, and the clock signal C1 being inputted to the source and a drain connected to the gate line;

a second transistor having a gate connected to the Qb output terminal, a source connected to the drain of the first transistor and the gate line, and a drain connected to a ground, wherein the scan signal has a turn off period, and a turn on period including a first period for partially turning on a thin film transistor and a second period for fully turning on a thin film transistor, where the first period is shorter than the second period, and wherein the turn on period is extended by a width corresponding to the first period.

9. The method of claim 8, wherein the first and second transistors are made of an amorphous semiconductor.

10. The method of claim 9, comprising directing such that the scan signals being sent to adjacent gate lines have pulse widths that overlap each other.

11. The method of claim 10, comprising directing the first gate driving unit and the second gate driving unit to generate synchronized signals sequentially.

12. The method of claim 11, comprising:

generating a start signal;

receiving the start signal via a shift register; and generating output voltages in response to the received start signal.

* * * * *